US009091218B2

(12) United States Patent
Yapici

(10) Patent No.: US 9,091,218 B2
(45) Date of Patent: Jul. 28, 2015

(54) VALVE TRAIN AND METHOD FOR CONTROL TIME VARIATION

(76) Inventor: Kurt Imren Yapici, Eschweiler (DE)

( * ) Notice: Subject to any disclaimer, the term of this patent is extended or adjusted under 35 U.S.C. 154(b) by 0 days.

(21) Appl. No.: 14/009,840

(22) PCT Filed: Apr. 10, 2012

(86) PCT No.: PCT/DE2012/000373

§ 371 (c)(1),
(2), (4) Date: Dec. 6, 2013

(87) PCT Pub. No.: WO2012/149921

PCT Pub. Date: Nov. 8, 2012

(65) Prior Publication Data

US 2014/0096729 A1 Apr. 10, 2014

(30) Foreign Application Priority Data

Apr. 7, 2011 (DE) ..... 10 2011 016 384

(51) Int. Cl.

| | |
|---|---|
| ***F01L 1/18*** | (2006.01) |
| ***F02D 13/02*** | (2006.01) |
| ***F01L 13/00*** | (2006.01) |
| *F01L 1/24* | (2006.01) |

(52) U.S. Cl.

CPC ..... *F02D 13/02* (2013.01); *F01L 13/0026* (2013.01); *F01L 13/0063* (2013.01); *F01L 1/185* (2013.01); *F01L 1/2405* (2013.01); *F01L 2105/00* (2013.01)

(58) Field of Classification Search

CPC ..... F01L 1/185; F01L 1/2405; F01L 13/0026; F01L 13/0063; F01L 2105/00; F02D 13/02

USPC ..... 123/90.16, 90.6, 90.39, 90.44; 74/569

See application file for complete search history.

(56) References Cited

U.S. PATENT DOCUMENTS

| | | | |
|---|---|---|---|
| 6,837,197 | B2 | 1/2005 | Cecur |
| 7,311,073 | B1 | 12/2007 | Kim et al. |
| 7,314,029 | B2 | 1/2008 | Hiraiwa |
| 8,079,333 | B2 | 12/2011 | Choi et al. |

FOREIGN PATENT DOCUMENTS

| | | | |
|---|---|---|---|
| DE | 10 2004 040652 | A1 | 2/2006 |
| DE | 10 2004 058106 | A1 | 6/2006 |
| DE | 10 2006 056434 | A1 | 5/2007 |
| DE | 10 2009 004 224 | A1 | 1/2010 |
| EP | 1 039 103 | A2 | 9/2000 |
| EP | 1 462 623 | A1 | 9/2004 |
| FR | 2 663 078 | A1 | 12/1991 |
| WO | WO 03/095805 | A1 | 11/2003 |
| WO | WO 2005/026503 | A2 | 3/2005 |
| WO | WO 2005/052326 | A1 | 6/2005 |

OTHER PUBLICATIONS

International Search Report of PCT/DE2012/000373, date of mailing Nov. 8, 2012.

International Preliminary Report on Patentability of PCT/DE2012/000373, dated Oct. 8, 2013.

*Primary Examiner* — Ching Chang

(74) *Attorney, Agent, or Firm* — Collard & Roe, P.C.

(57) ABSTRACT

The invention relates to a link lever of a valve train, which is rotatably mounted on a swing arm of the valve train by means of a stationary link point having an intermediate cam follower that follows a camshaft, wherein the swing arm supports a cam track that drives a valve.

16 Claims, 11 Drawing Sheets

VALVE TRAIN AND METHOD FOR CONTROL TIME VARIATION

CROSS REFERENCE TO RELATED APPLICATIONS

Figure 3:
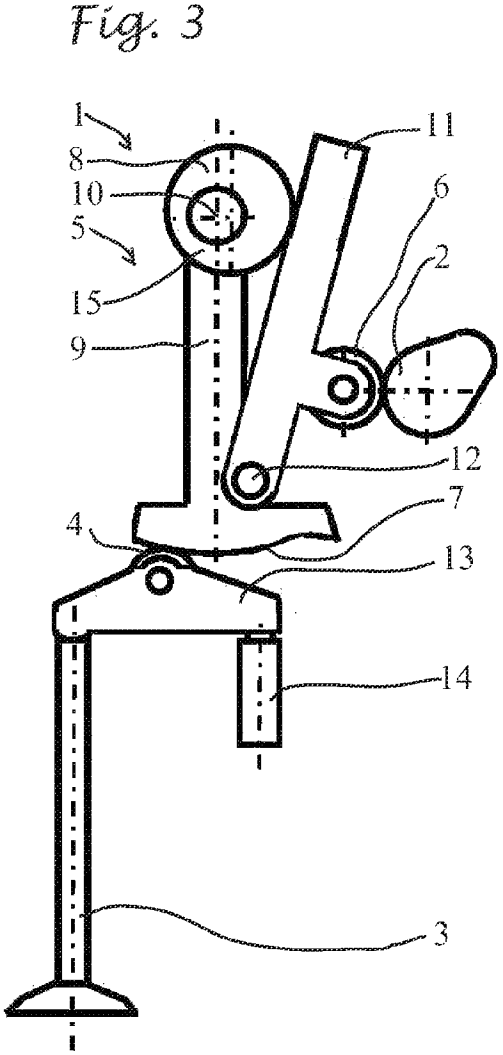

This application is the National Stage of PCT/DE2012/000373 filed on Apr. 10, 2012 which claims priority under 35 U.S.C. §119 of German Application No. 10 2011 016 384.0 filed on Apr. 7, 2011, the disclosure of which is incorporated by reference. The international application under PCT article 21(2) was not published in English.

The invention relates to a valve train for a piston engine having a control time variation, as well as to a method for variation of the control times of a valve of a piston engine.

Load control of gasoline engines, in particular, usually takes place by means of limiting the cylinder fill level. Frequently, a throttle valve is used for this purpose, with which the fill level is reduced as the result of flow losses at the valve. This method of load control is subject to losses, whereby a way of avoiding or reducing these losses is known from the state of the art, in which the use of a fully variable valve train is known for fill level regulation. In this connection, the term "fully variable" is understood to be a valve train in which the duration of opening of the valves of one type of function, preferably the duration of opening of the inlet valves, can be freely selected within thermodynamically reasonable limits. This is usually or frequently supplemented with an apparatus that allows a phase shift between camshaft and crankshaft.

Important criteria for fully variable valves are their demand for construction space, their friction power, and the costs as well as the robustness with regard to production tolerances.

Piston engines having a control time variation, or valve drives for a piston engine having a control time variation, having a camshaft and having at least one valve that is driven by the camshaft by way of a valve cam follower, and a corresponding method for variation of the control times of a valve of a piston engine are sufficiently known from the state of the art. Thus, for example, DE 10 2009 004 224 A1 or U.S. Pat. No. 7,311,073 B1 discloses such an apparatus or method, whereby a lever arrangement is disposed between the camshaft and the valve cam follower, which arrangement has an intermediate cam follower for the camshaft, on the one hand, and a cam track for the valve cam follower, on the other hand, whereby the lever arrangement can be varied by way of an actuator, for control time variation. While in the arrangement according to DE 10 2009 004 224 A1, a corresponding roller, which serves as an intermediate cam follower, is mounted in floating manner, which is relatively complicated in terms of coordination and installation, in the arrangement according to U.S. Pat. No. 7,311,073 B1 a swing lever having a rotation point fixed in place on the housing is provided, whereby the swing lever is driven by way of a link lever that has the intermediate cam follower, and the link lever can be varied with regard to the swing lever by means of an eccentric element as an actuator. The swing lever itself then carries the cam track for the valve cam follower, which in turn then acts on a tappet of the valve in known manner.

It is the task of the present invention to make available a valve train of the type indicated and a control time variation method of the type indicated, which allow the greatest possible freedom of movement in the design of the valve stroke and the related control times, as a function of the construction.

As a solution, a valve train and a control time variation method having the characteristics of the independent claims, in each instance, are proposed. Particularly preferred embodiments are found in the dependent claims.

If the link lever is mounted on the swing lever so as to rotate, by way of a link point, or if the link lever rotates, relative to the swing lever, about a stationary link point, then this allows increased freedoms in the valve stroke configuration or the influence on the control times, as a function of the construction. In this connection, the lever length of the link lever and the selection of the link point on the swing lever, as well as of the region in which an actuator engages on the link lever and/or on the swing lever are available in addition to the otherwise usual possibilities in valve stroke or control time configuration of devices or methods of the stated type. Nevertheless, the additionally required construction space can be reduced to a minimum by means of a corresponding compact method of construction.

It is true that this embodiment has the apparent disadvantage, at first glance, that more mass must be moved back and forth with the swing frequency of the swing lever, because the stationary link point as well as a related bearing an the link lever must also be moved along, accordingly. On the other hand, such bearings at the link point can be selected to be relatively small, because, here, only very few relative movements must be expected, which on the one hand also reduces possible friction losses to a minimum. In this regard, these disadvantages prove to be only ostensible, in practice, and can be more than outweighed by the greater freedoms in the valve stroke and control time configuration.

In this connection, the link point can particularly be disposed spatially between the cam track and the rotation point of the swing lever, particularly in order to be able to take spatial conditions into account.

In this connection, it should be emphasized that the description "spatially between" is aimed at a spatial arrangement of the corresponding modules or components, different from the mere use of the term "between," whereby for a corresponding determination whether a specific component or a module is disposed spatially between two other components or modules, a segment having at least one of these two components or modules, in each instance, is formed between the latter, and a plane that stands perpendicular on this segment is laid through each of these two components or modules. If the specific component or the specific module is situated between these two planes, then it is disposed spatially between the two corresponding components or modules. In a refinement of this definition, a corresponding group of segments can be formed if the two components or modules have a spatial expanse, which then leads to corresponding groups of planes, whereby then, a specific component or a specific module lies between the corresponding components or modules if the specific component or the specific module can be found within the free space that remains between the two groups of planes.

Thus, it is particularly possible that the region in which an actuator, for example a corresponding eccentric element, engages on the link lever is disposed on the same side of the intermediate lever as the intermediate cam follower. In this way, a relatively large amount of construction space remains, particularly on the other side of the intermediate lever.

As an alternative to this, it is possible that the region in which the actuator or a corresponding eccentric element engages on the link lever can be disposed on the other side of the intermediate lever as the intermediate cam follower, which leads to the result that relatively long lever arms and a very short distance remain between the intermediate lever and the camshaft with the cam follower that engages on it.

As an alternative to the arrangement of the link point spatially between the cam track and the rotation point of the swing lever, the rotation point of the swing lever can be disposed spatially between the cam track and the link point. This also allows relatively long lever lengths, if this is possible in terms of the construction space, whereby then, the overall arrangement can be built relatively high but also relatively narrow.

In a preferred embodiment, the angle between the swing lever and the link lever can be varied to adjust the valve control time. In this connection, a different angle position is then preferably provided for each valve control time, while a position-variable surface area or another element of the actuator that can be changed in terms of its position, such as an eccentric surface of an eccentric element, for example, on which the link lever supports itself, is changed in its position, for a variation of the opening time. In this way, the angle range within which the movement of the swing lever takes place about its axis, which is stationary with regard to the swing movement, changes. In this connection, an increase or decrease in the angle range can furthermore come about, thereby also influencing the duration of opening in a corresponding, if applicable smaller degree. By means of the stationary rotation point, whereby in the present connection the term "stationary" comprises a rotation point fixed in place on the housing, on the one hand, or a rotation point provided on an eccentric element, so that the rotation point is specifically not moved at the frequency of the swing lever but rather significantly more slowly, the valve train can be presented to be relatively non-sensitive to tolerances. The same holds true, of course, also for the implementation as a corresponding control time variation method.

In a preferred embodiment, the link lever can be variable by means of a rotation angle at the link point. Likewise, in this regard, an eccentric element or another support surface or an adjustable component of the actuator can be used, if necessary.

In particular, it is possible to assign the corresponding surface area of an eccentric element or a corresponding module of the actuator to the rotation point of the swing lever, something that can be easily implemented structurally, where, if necessary, an axis of rotation of the swing lever can actually be used as a support of a corresponding eccentric element. Depending on the concrete embodiment, however, the corresponding module of the actuator or a corresponding eccentric element can also be disposed at a different location.

In accordance with a concrete implementation, the link lever can rotate about the same rotation point as the intermediate lever. However, link levers that rotate about a link point that is different from the rotation point of the intermediate lever are preferred, because in this way, particularly many freedoms in the valve stroke configuration or in the variation of the valve control time remain.

The swing lever can be structured in such a manner that it has an idle stroke region with regard to the cam follower, in other words in this region the cam track runs concentric to the rotation point of the swing lever, so that no movement of the cam follower is initiated by the swing lever as long as the pickup of the cam follower takes place there. In this connection, it should be emphasized that such an embodiment can advantageously be used also independent of the other advantages or characteristics of the present invention in a fully variable valve train, particularly in the valve train of the stated type, as well as in a fully variable control time variation method, and, in particular, in a control time variation method of the stated type. In this connection, it should particularly be stated, in this regard, that a control time variation can change not only the length of the control time, measured from an opening all the way to a closing of the valves, but rather, that the stroke of a valve can essentially be influenced by means of the variation of the control time. In this connection, a control time variation approximately all the way to a zero stroke of the valves is possible. In this regard, it is also possible to implement a cylinder shutoff as the result of a non-opening valve on the piston engine in this way.

If the valve train is used for a multi-cylinder engine, for example for a six-cylinder inline engine, then independent activation for each individual cylinder or cylinder groups, for example, is basically possible. In the case of a six-cylinder engine, an actuator shaft could therefore be used for two cylinder groups, in each instance, for example. In this way, cylinder shutoff or extensive shutdown or load reduction of individual cylinders or cylinder groups can be implemented by means of separate load control of multiple cylinders or cylinder groups, because continuous turn-on and shutoff are possible, in contrast to switchable valve trains.

In particular, actuator shafts of the actuators, in each instance, which shafts have different configurations, can be used, particularly as different eccentric elements for individual turn-on of the valves of individual cylinders or of individual valves. Likewise, divided or separate actuator shafts of the actuator or actuators are possible, so that at first, for example, all the cylinders can be set to half load, and subsequently, half of the cylinders or selected cylinders are further reduced in load, while other cylinders are increased in load again, which allows almost unnoticeable cylinder shutoff by means of a torque-neutral transition in the range of half the load, for example. If necessary, this can also take place in other load ranges, in that different numbers of cylinders have a load placed on them or their load is relieved.

Depending on the concrete implementation, fully variable mechanical valve trains can have the disadvantage that they have lesser valve strokes at shorter control times than would be desirable from thermodynamic aspects. As has already been explained above, this can be prevented, to a great extent, in that the angle swing of the swing lever is increased in the case of shorter control times. As a supplemental or alternative measure, such a valve train can be combined with switchable geometries in two or more positions. A large number of possibilities known from the state of the art can be used for this purpose. Thus, for example, the intermediate cam follower and one or more modules that carry it could be structured to be axially displaceable, in order to optionally pick up one of two or more available cam profiles by the camshaft. Alternatively, for example, multiple cam tracks, also called stroke contours, can be disposed one behind the other in the axial camshaft direction, only one of which is in use at any time, whereby here, too, switching could be implemented by means of an axial displacement.

Preferably, a lever section of the link lever can be varied between the rotation point of the swing lever and the intermediate cam follower, thereby making it possible to initialize a control time variation or a variation in the stroke in particularly effective manner. In particular, it is possible, in the case of such an embodiment, to couple the variation of the link lever with the variation of the lever section, so that here, a particularly simple structural implementation can be carried out.

If the valve train is structured by means of a cam translator between the cam track and the valve, which translator has two supports fixed on the housing, of which at least one of the supports is structured in reinforceable manner, the cam stroke translation can be changed, in this way, even independent of the other characteristics of the present invention in a fully variable valve train or in a corresponding control time variation method, whereby in particular, the disadvantages mentioned above are also taken into account in this way. In this regard, a variable cam translation also allows corresponding compensation in the case of a control time variation method.

Preferably, this can be implemented in that the two supports have a different distance from the valve, whereby when the one support is reinforced, this support is used as the support for the cam stroke translator, while the other support is used for the cam stroke translator when the support that is structured so that it can be reinforced is not reinforced and is therefore resilient.

In particular, corresponding supports can be implemented by means of hydraulically activated elements for valve play equalization, whereby then, in every position, only one hydro-tappet can have oil pressure applied to it, and the other one can remain resilient. If necessary, the hydro-tappets can be equipped with an additional valve for this purpose, which opens the oil space when required, so that no oil pressure can build up, while the other hydro-tappet can then serve as a support for the cam translator.

Accordingly, a control time variation method is also proposed, in which a cam stroke translator is supported by way of two supports fixed in place on the housing, of which at least one is changed in terms of its rigidity during operation, whereby the lever arm can be shortened, particularly at small valve strokes. In the case of shorter opening times for the inlet valves, a displacement of the valve lift in the direction of earlier opening times is generally desired, for which purpose the present valve train or the control time variation method can be combined with a camshaft setting element, in order to obtain the optimal opening time point at every control time length. In this connection, the valve drive can be structured, at a suitable position of the link point in connection with the matching direction of rotation of the camshaft, in such a manner that when the control time is shortened, a displacement, in other words a phase adjustment of the control time automatically takes place, relative to the crankshaft, in the direction of earlier opening time points.

Preferably, for this purpose, the link lever, without any further intermediate lever, is driven by the camshaft directly or by way of a roll pickup, whereby the contact location to the camshaft is displaced counter to the direction of rotation to the camshaft, at shorter control times. Accordingly, a control time variation method is preferably also implemented in such a manner that during the variation of the control time, the phase of the control time relative to a crankshaft of the piston engine is adjusted, whereby preferably, the phase adjustment of the control time relative to the crankshaft takes place in the "early" direction.

It is understood that the characteristics of the solutions described above and in the claims can also be combined, if necessary, in order to be able to implement the advantages cumulatively, accordingly.

Figure 2:
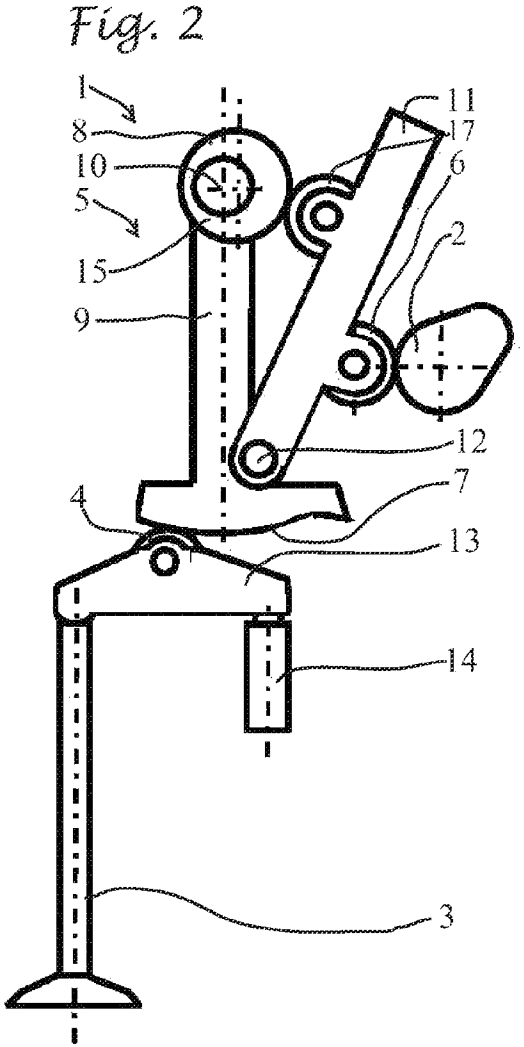
Figure 1:
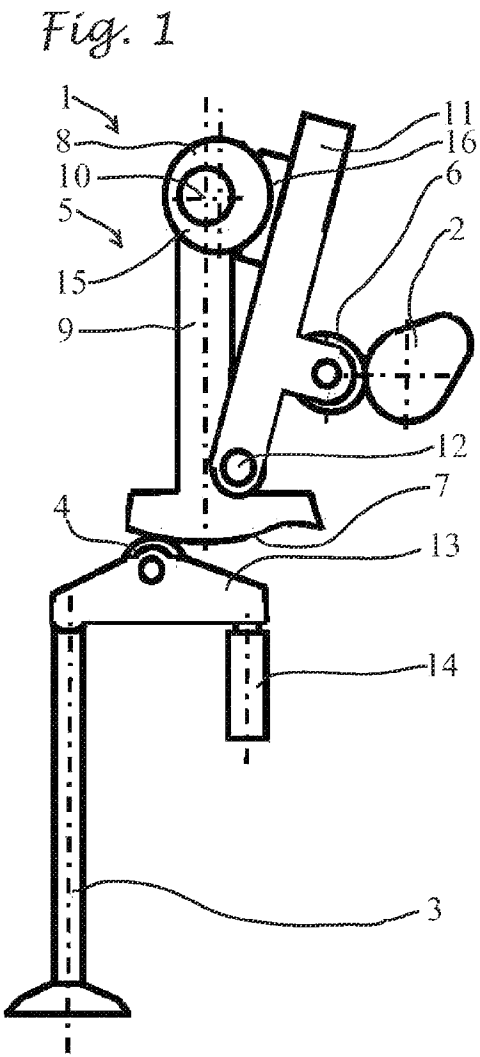
Figure 5:
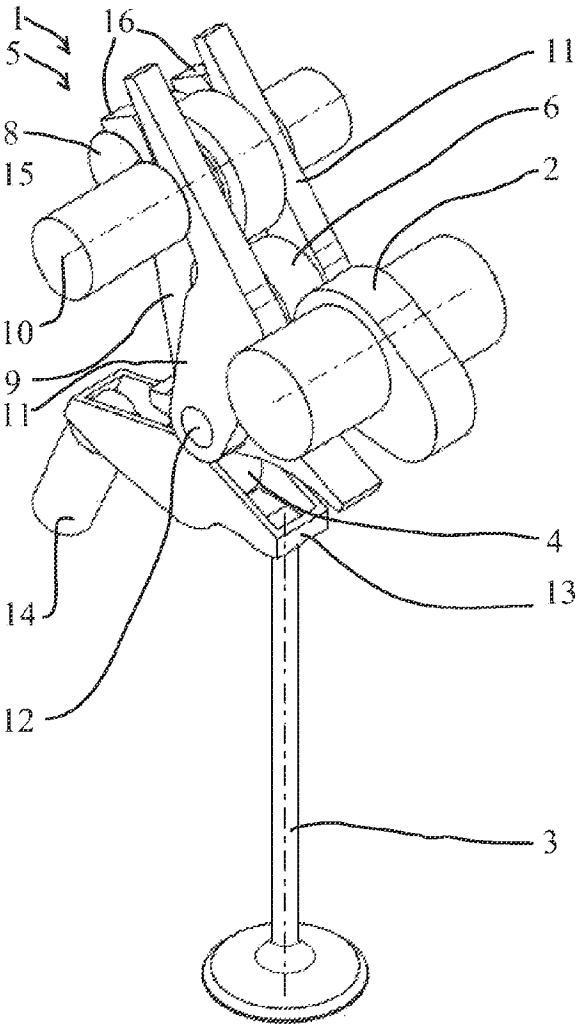
Figure 4:
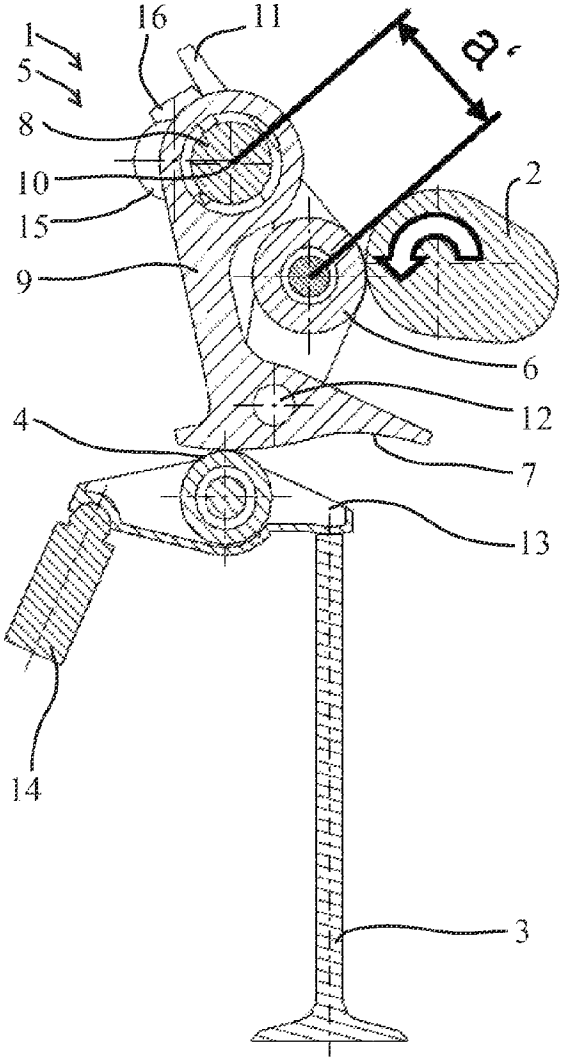
Figure 7:
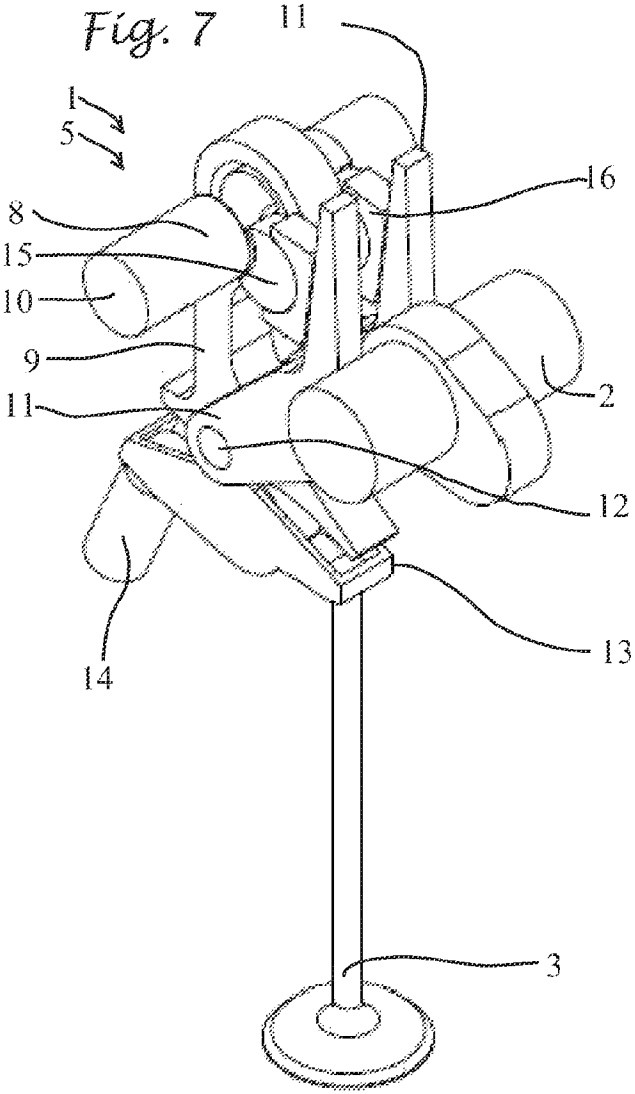
Figure 6:
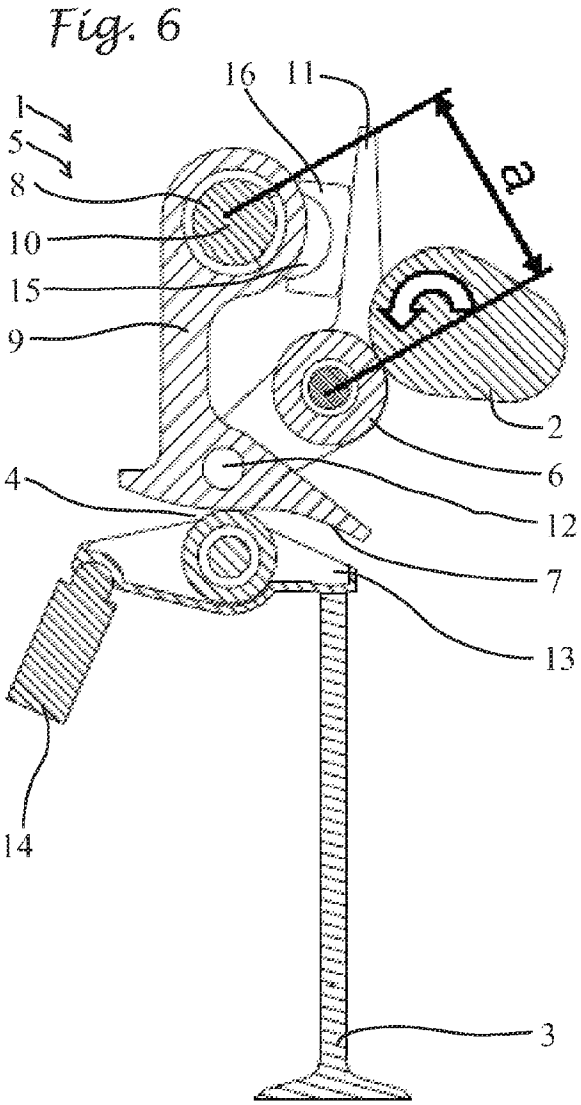
Figure 8:
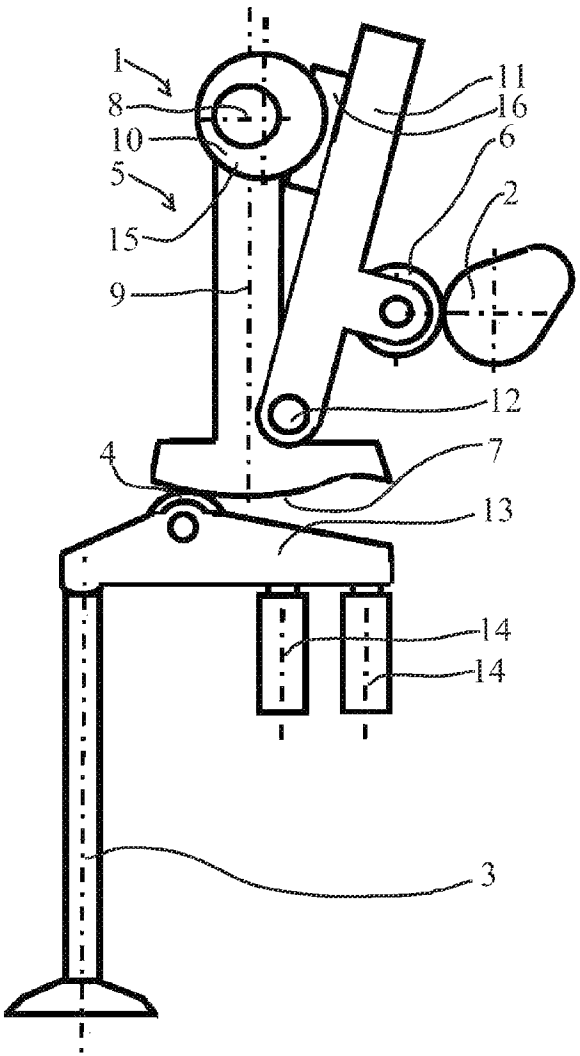
Figure 10:
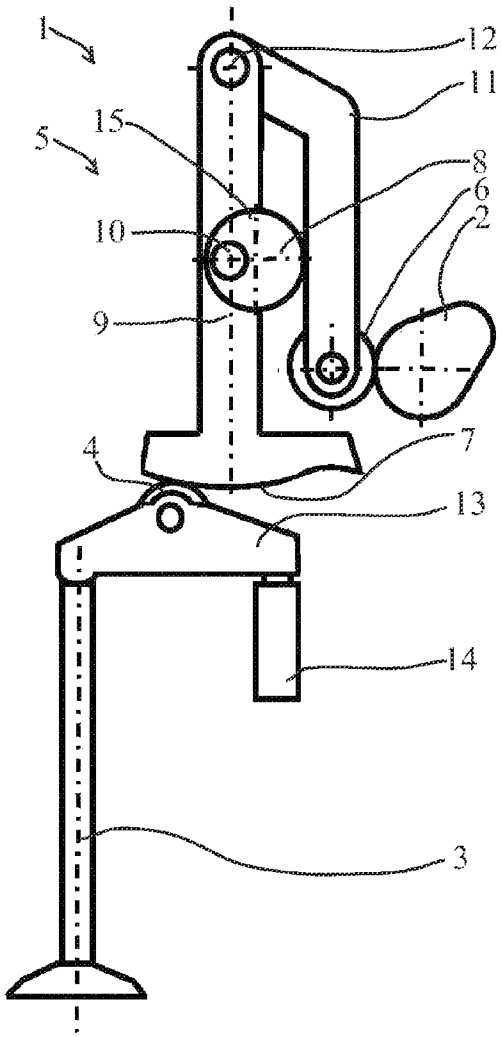
Figure 9:
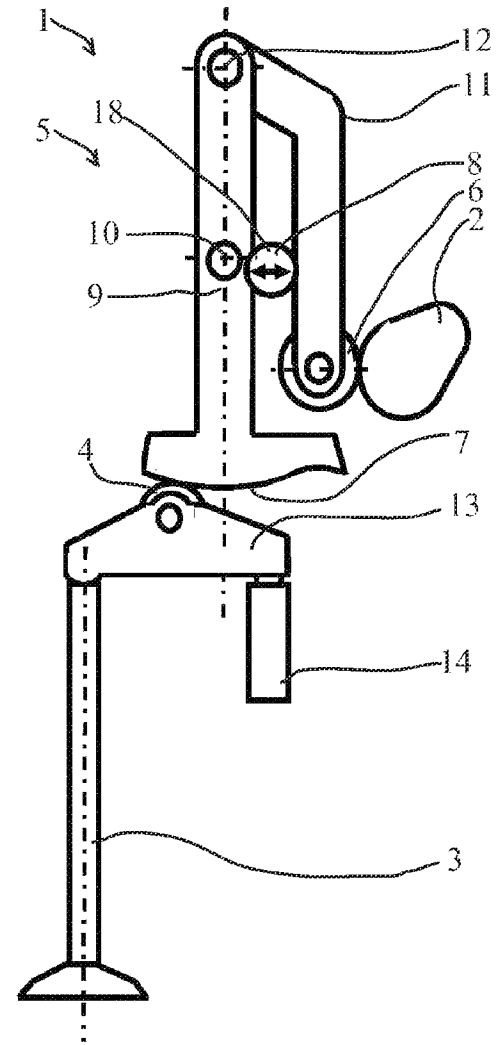
Figure 11:
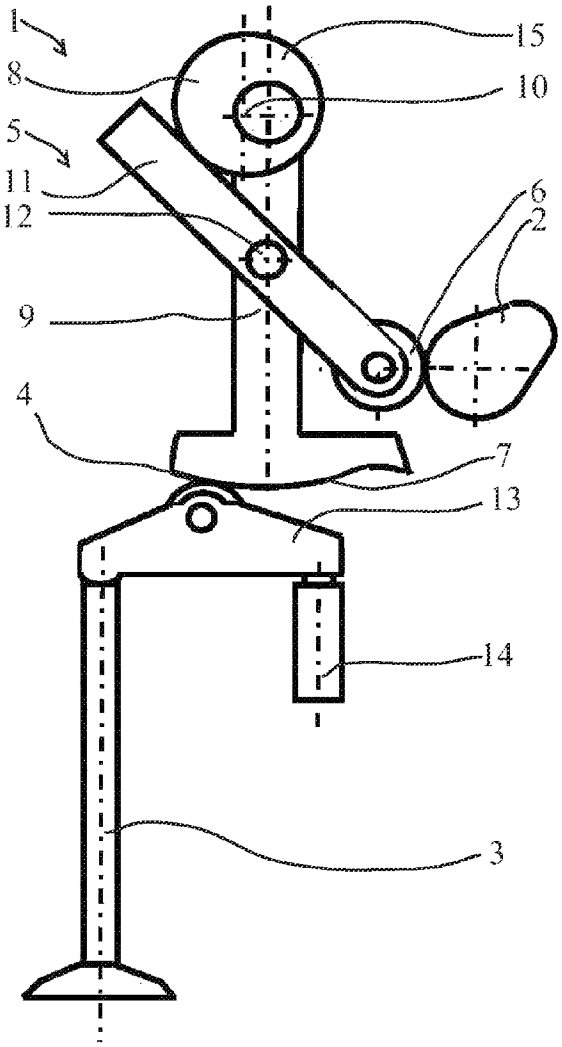
Figure 12:
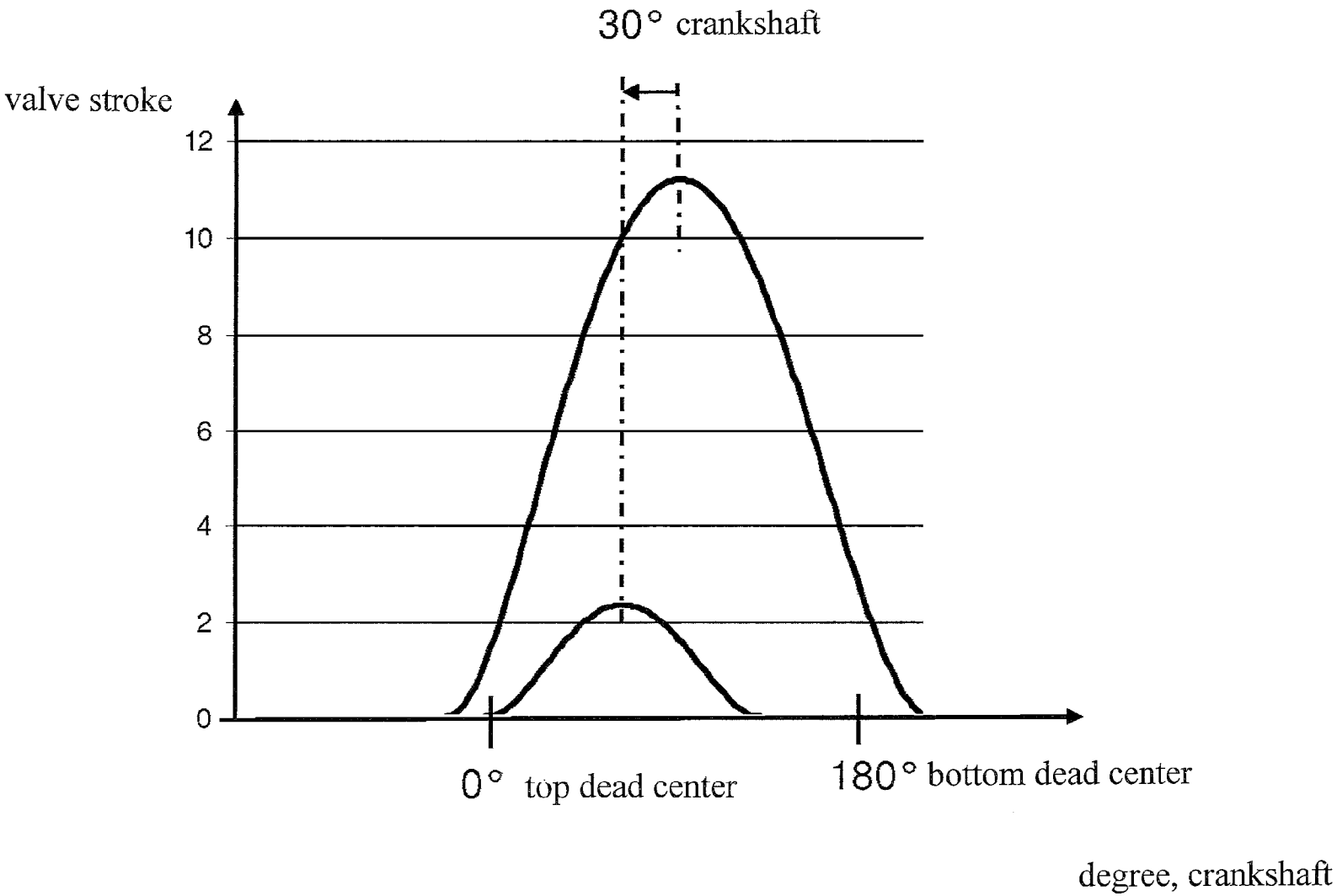
Figure 14:
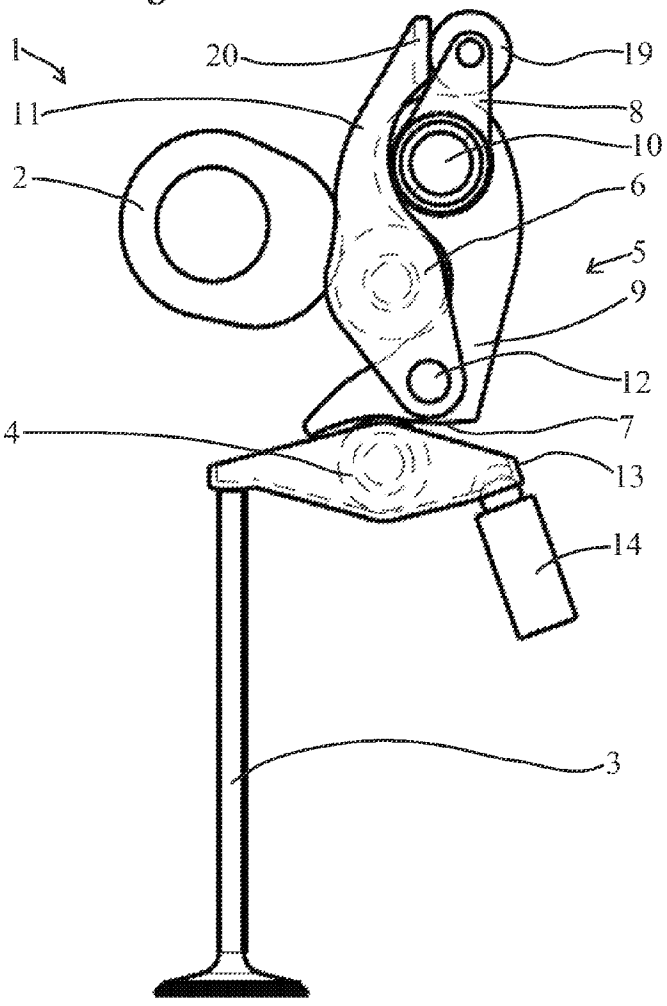
Figure 13:
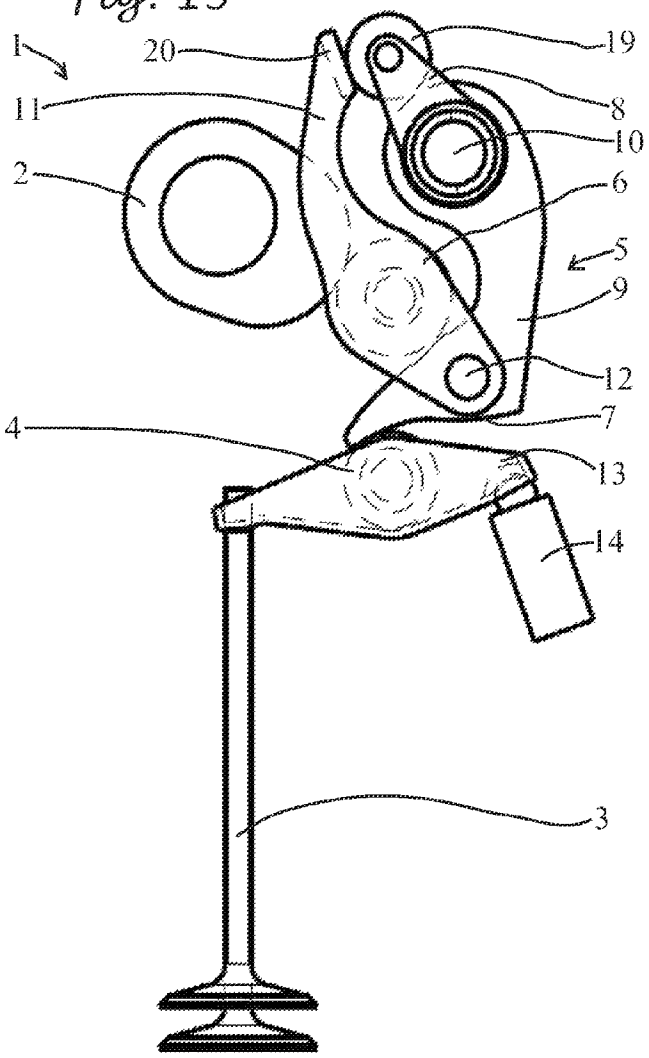
Figure 15:
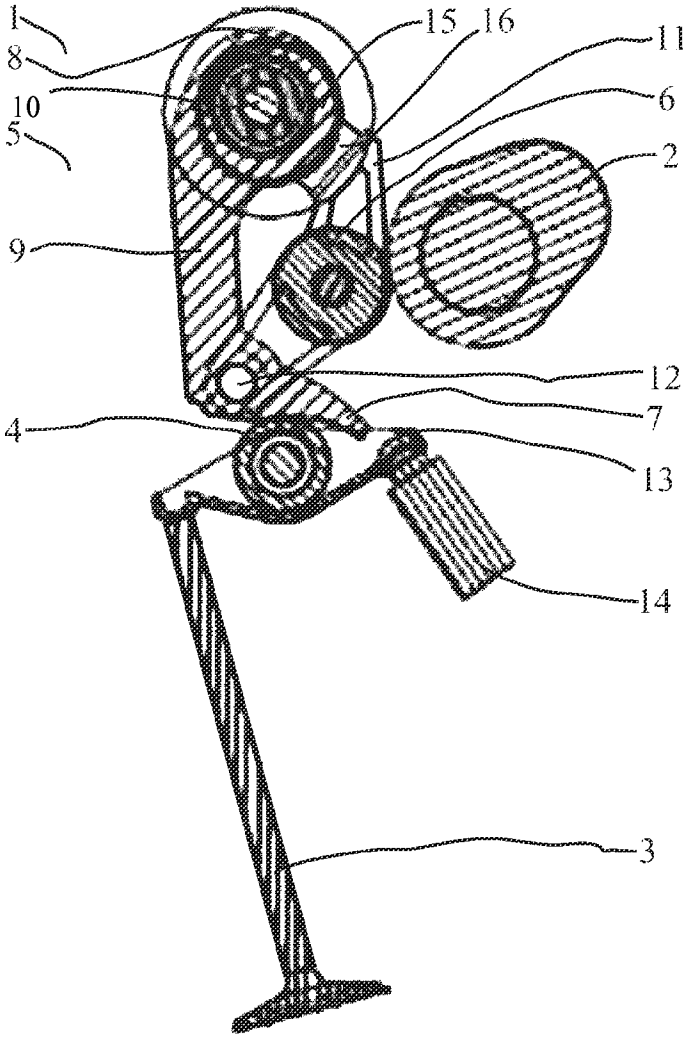
Figure 18:
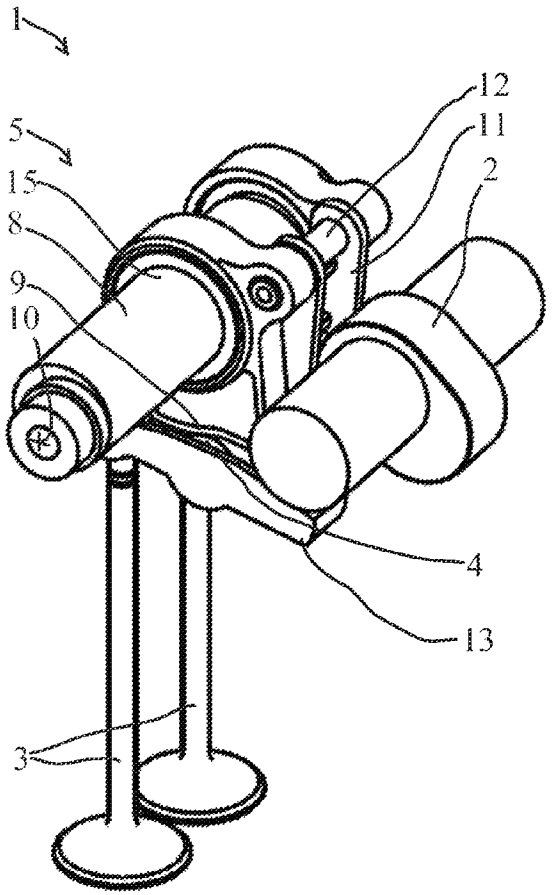
Figure 17:
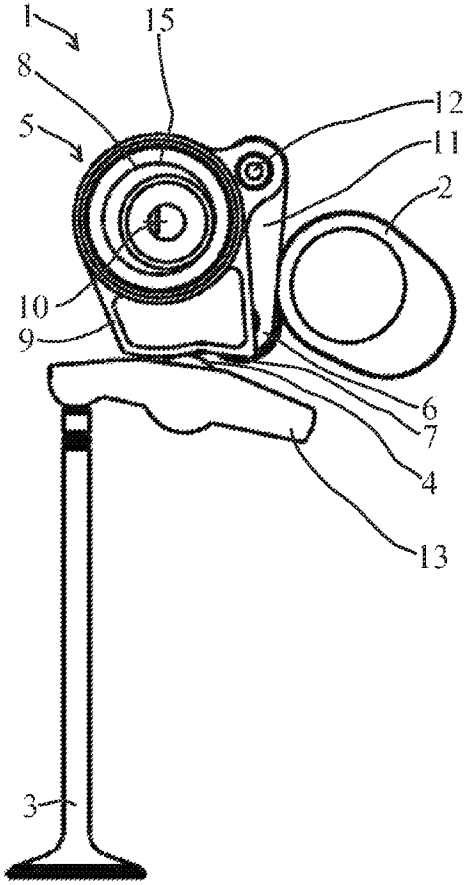
Figure 16:
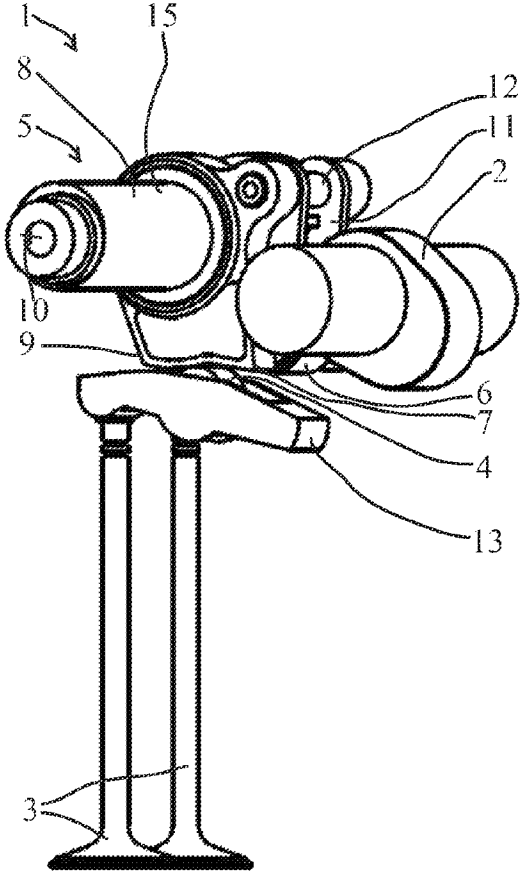
Figure 20:
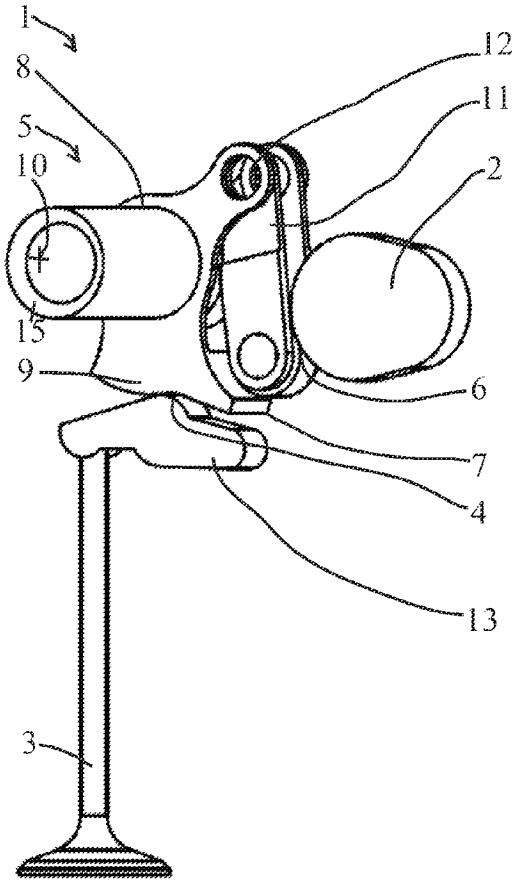
Figure 19:
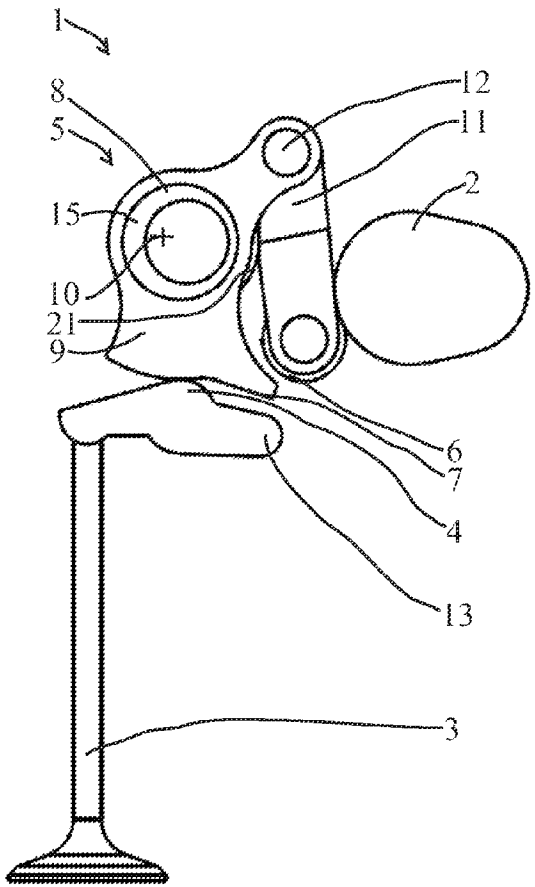

Further advantages, goals, and properties of the present invention will be explained using the following description of exemplary embodiments, which are particularly shown also in the attached drawing. The drawing shows:

FIG. 1 a first schematic side view of a valve train according to the invention;

FIG. 2 an alternative embodiment of the valve train according to FIG. 1;

FIG. 3 a further alternative embodiment of the valve train according to FIG. 1;

FIG. 4 a concrete implementation of the valve train according to FIG. 1, in section;

FIG. 5 the arrangement according to FIG. 4 in a perspective view;

FIG. 6 the arrangement according to FIGS. 4 and 5 in an operating position;

FIG. 7 the arrangement according to FIG. 6 in a perspective view;

FIG. 8 a valve train similar to FIG. 1 with two supports;

FIG. 9 an alternative valve train;

FIG. 10 the alternative valve train in an alternative embodiment;

FIG. 11 a further alternative valve train;

FIG. 12 a valve stroke progression for two different control time lengths of the arrangement according to FIGS. 4 to 7;

FIG. 13 a valve train similar to FIG. 1 in an alternative embodiment;

FIG. 14 the valve train according to FIG. 13 in a different operating position;

FIG. 15 a further concrete implementation of the valve train according FIG. 1;

FIG. 16 an implementation of the valve train according to FIGS. 9 and 10 for two valves per cam in a slanted view;

FIG. 17 the arrangement according to FIG. 16 in a side view;

FIG. 18 the arrangement according to FIGS. 16 and 17 in a perspective view;

FIG. 19 a valve train similar to FIGS. 16 to 18, but only for one valve per cam;

FIG. 20 the arrangement according to FIG. 19 in a slanted view; and

Figure 21:
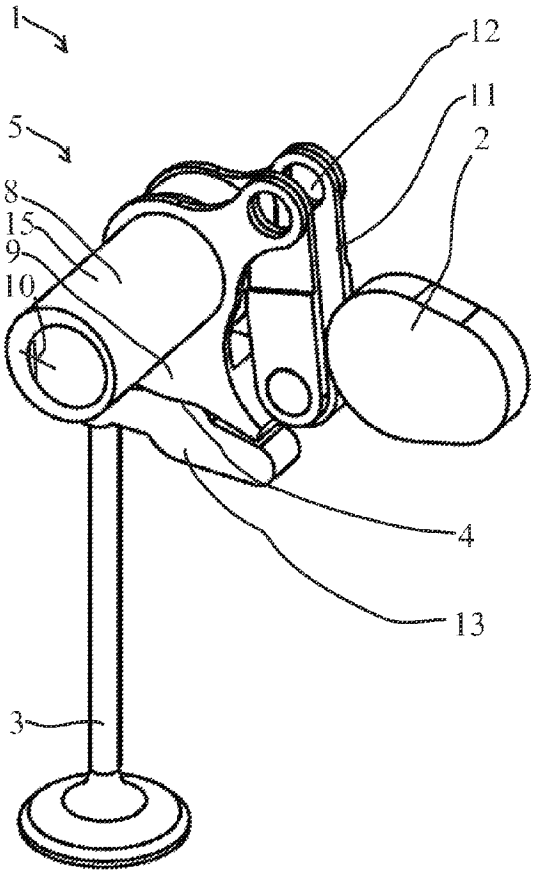

FIG. 21 the arrangement according to FIGS. 19 and 20 in a perspective view.

In all the arrangements shown in the figures, at least one valve 3 is driven by way of a valve train 1 that comprises a camshaft 2, by way of a valve cam follower 4 that is provided on a cam stroke translator 13, which is supported on a support 14 on its side facing away from the valve 3.

In this connection, the valve train 1 comprises a swing lever 9, in each instance, on which a cam track 7 is provided, which interacts with the valve cam follower 4, whereby the swing lever 9 swings about a rotation point 10, so that the cam track 7 positions the valve cam follower 4 accordingly, swinging about the rotation point 10.

The swing lever 9 is part of a lever arrangement 5 that comprises the valve cam follower 4, on the one hand, and an intermediate cam follower 6, on the other hand, which in turn lies against the camshaft 2 and interacts with it. The lever arrangement is biased by way of springs or by way of other application devices, in known manner, so that the intermediate cam follower 6 can follow the camshaft track of the camshaft 2, and the lever arrangement 5 and, in particular, also the cam track 7 can swing back and forth at the circular frequency of the camshaft 2, accordingly.

The lever arrangement 5 furthermore comprises a link lever 11 that is mounted, so as to rotate, on the swing lever 9, by way of a link point 12, so that the link lever 11 rotates relative to the swing lever 9, about a stationary link point, namely the link point 12.

Furthermore, an actuator 8 is provided, by means of which the link lever 11 can be varied with reference to the swing lever 9, so that the effect of the movement of the intermediate cam follower 6 caused by the camshaft 2 can be influenced, by way of the lever arrangement 5, to the movement of the swing arm 9 and thereby to the movement of the cam track 7.

In the exemplary embodiment shown in FIG. 1, the actuator 8 is implemented by means of an eccentric element 15, which is disposed on the rotation point 10 of the swing lever 9 and on which a motion link 16 that is mounted on the link lever 11, so as to be displaceable in linear manner or on a curved track, lies as a slide block. By means of rotation of the eccentric element 15, the relative position of the link lever 11 with regard to the swing lever 9 can be varied in desired manner. The exemplary embodiment shown in FIG. 15 also corresponds to this embodiment, but with a slightly angled and slightly shorter link lever 11.

The exemplary embodiment shown in FIG. 2 essentially corresponds to the exemplary embodiment according to FIG. 1, whereby instead of a motion link, a wheel 17 lies against the eccentric element 15 and picks up the movement of the latter accordingly.

In the exemplary embodiment shown in FIG. 3, in contrast, the link lever itself lies directly against the eccentric element 15.

In the exemplary embodiment shown in FIGS. 4 and 5, too, the actuator 8 comprises an eccentric element 15, whereby the corresponding eccentric disk is configured to be smaller than in the exemplary embodiments explained above. Also, the link lever 11 is configured to be angled, thereby making a corresponding variation of the reaction of the overall arrangement as well as a compact construction possible.

To adjust the control time of the valve, the angle between the swing lever 9 and the link lever 11 can be varied in all the exemplary embodiments. In this connection, there is a different angle position for each valve control time.

For variation of the opening time, a position-variable surface area of the eccentric element, on which the link lever supports itself, is changed in terms of its position for this purpose, in the exemplary embodiments described above. As a result, the angle range within which the movement of the swing lever 9 about its rotation point 10 or about its axis of rotation takes place is changed. In this connection, an increase or reduction of this angle range can furthermore come about, thereby also making it possible to influence the opening duration, to a lesser extent.

As the exemplary embodiment according to FIG. 1 shows, the variable surface area of the eccentric element 15 of the stationary bearing axle of the swing lever 9, which lies on the rotation point 10 of the swing lever 9 and can in turn be rotated, can easily be used for a corresponding variation.

All the functional surfaces or functional modules can be structured in multiple parts, whereby embodiments in which a symmetrical component load occurs in a plane perpendicular to the camshaft are preferred. By means of the structure in multiple parts, it is possible to implement symmetrical component loads.

In order to always guarantee secure contact between the link lever 11 or the swing lever 9 and the camshaft 2 or the transfer elements that might be switched in between, a spring force that presses the lever arrangement 5 in the direction of the camshaft 2 is used. In this connection, this spring can either engage on the swing lever 9 or the link lever 11 and a stationary position, or can brace the link lever 11 and the swing lever 9, relative to one another, in suitable manner.

For the link point 12 of the link lever 11 on the swing lever 9, a great number of different positions are possible; in this connection, the lever section of the link lever 11 can turn out differently between the rotation point 10 of the swing lever 9 and the intermediate cam follower 6 for different valve control times.

Thus, the functional surface for contact with the position-variable activation surface of the actuator, such as, for example, of the eccentric element 15, can be disposed in such a manner that the angle range in which the swing lever swings cyclically is greater at small, short valve opening times, as shown in FIGS. 4 and 5, than at long opening times as shown in FIGS. 6 and 7. In this manner, the valve stroke heights can be increased at short control times, and the throttle losses can be minimized.

Such a geometry can be presented, for example, in that the contact surface between the position-variable surface area of the actuator 8 and the link lever 11 moves closer to the rotation point 10 of the swing lever 9 when the control time length is shortened. In FIGS. 4 and 5, for example, the system is in a position for short control times, whereby the distance a' between the intermediate cam follower 6 and the rotation point 10 of the swing lever 9 turns out to be clearly smaller than the distance a in FIGS. 6 and 7, in which the same system is in a position for long control times.

In the case of shorter opening times for the valves 3, a displacement of the valve elevation toward earlier opening times is generally desired. For this purpose, the fully variable valve control can be combined with a camshaft setting element, in order to obtain the optimal opening time point at every control time length.

The valve train 1 can be structured, in the case of a suitable position of the link point 12 for the link lever 11, in combination with the matching direction of rotation of the cam shaft, as shown in FIGS. 4 to 7 as an example, in such a manner that when the control times are shortened, a displacement, in other words a phase adjustment of the control time with regard to the crankshaft, in the direction of earlier opening time points, automatically takes place.

In this connection, for example, the link lever 11 is activated without an intermediate lever, by the camshaft 2, directly or by way of a roll pickup, whereby the contact location to the camshaft 2 shifts counter to the direction of rotation, toward the camshaft 2, in the case of shorter control times.

FIG. 12 shows the valve stroke progression for two different control time lengths over the crank angle for an arrangement in accordance with FIGS. 4 to 7, as an example. It can be seen from FIG. 12 that an early displacement is connected with the shortening of the control time; in this case it is a crank angle of about 30°. In this connection, "phase of the control time" always means the maximum of a valve elevation curve, in each instance, as a reference point. Thus, a phase shift of 30°, for example, relates to the displacement of the point of the maximal valve stroke, independent of the value of the valve stroke and independent of the valve opening time.

The link point 12 of the link lever 11 on the swing lever 9 can be disposed in different ways, in order to take the available construction space, in each instance, into consideration; for example, it can lie on a side facing away from the opening contour, as shown as an example in FIGS. 9 and 10, whereby here, too, the position-variable surface area for setting the angle work range of the activation lever is structured as a separate part 18 (see FIG. 9) or can be integrated into the bearing axle of the swing lever 9, in the form of an eccentric element 15 (see FIG. 10). Also, an intersecting structure of swing lever 9 and link lever 11 is possible, as shown as an example in FIG. 11.

A roll 19 disposed eccentrically with reference to the rotation point 10 is used by the embodiment shown in FIGS. 13 and 14, whereby the roll 19 supports itself on a running surface 20 of the link lever 11, so that the angle between the link lever 11 and the swing lever 9 can be varied accordingly.

In accordance with the exemplary embodiment shown in FIGS. 9 and 10, the rotation point 10 of the swing lever 9 is also disposed spatially between the link point 12 of the link lever 11 and the cam track 7 in the exemplary embodiments shown in FIGS. 16 to 21, whereby the latter exemplary embodiments have a significantly more compact construction and are provided for one valve 3 (see FIG. 19 to 21) or for two valves 3 (see FIGS. 16 to 18). In these exemplary embodiments, the eccentric element 15 is also provided not only for the link lever 11 but also for the axis of rotation 10 of the swing lever 9, so that a very complex variation can be implemented, particularly in that a contact surface 21 for the link lever 11 is configured, depending on the concrete requirements, merely as a cylinder surface or as a specially shaped surface. These exemplary embodiments, too, have symmetrically configured, multi-part modules.

The exemplary embodiment shown in FIG. 8 furthermore has two supports 14, one of which is structured to be reinforceable, so that the lever section of the cam stroke translator 13 can be varied, in that the reinforceable support 14 is optionally reinforced or not reinforced.

REFERENCE SYMBOL LIST

1 valve train
2 camshaft
3 valve
4 valve cam follower
5 lever arrangement
6 intermediate cam follower
7 cam track
8 actuator
9 swing lever
10 rotation point of the swing lever 9
11 link lever
12 link point of the link lever 11
13 cam stroke translator
14 support
15 eccentric element
16 motion link
17 wheel
18 part of the actuator 8
19 roll
20 running surface
21 contact surface

The invention claimed is:

1. A valve train for a piston engine having a control time variation, having a camshaft and having at least one valve that is driven by the camshaft by way of a valve cam follower, wherein a lever arrangement is disposed between the camshaft and the valve cam follower, which has an intermediate cam follower for the camshaft, on the one hand, and a cam track for the valve cam follower, on the other hand, wherein the lever arrangement can be varied by way of an actuator for control time variation, and has a swing lever having a rotation point configured to be fixed in place on a housing or provided on an eccentric element, and a link lever, wherein the link lever has the intermediate cam follower, drives the swing lever, and can be varied with regard to the swing lever by way of the actuator, wherein the swing lever carries the cam track wherein the link lever is mounted, so as to rotate, on the swing lever, by way of a link point, wherein said actuator carries a roll disposed eccentrically with respect to the rotation point, and wherein said roll supports itself on a running surface of said link lever.

2. The valve train according to claim 1, wherein the link point is disposed spatially between the cam track and the rotation point of the swing lever.

3. The valve train according to claim 2, wherein the region in which the actuator engages on the link lever is disposed on the same side of the link lever as the intermediate cam follower.

4. The valve train according to claim 2 wherein the region in which the actuator engages on the link lever is disposed on the other side of the link lever from the intermediate cam follower.

5. The valve train according to claim 1, wherein the rotation point of the swing lever is disposed spatially between the cam track and the link point.

6. The valve train according to claim 1, wherein the cam track runs, at least in part, concentrically relative to the rotation point of the swing lever.

7. The valve train according to claim 1, wherein a lever section of the link lever can be varied between the rotation point of the swing lever and the intermediate cam follower.

8. The valve train according to claim 1, comprising a cam stroke translator between the cam track and the valve, wherein the cam stroke translator has two supports configured to be fixed in place on the housing, and wherein at least one of the supports is configured to be reinforceable.

9. The valve train according to claim 8, wherein the two supports are disposed at different distances from the valve, on the cam stroke translator.

10. The valve train according to claim 8, wherein the two supports are hydraulically activated elements for valve play equalization.

11. The valve train according to claim 1, wherein the actuator is an eccentric element.

12. The valve train according to claim 1, wherein the actuator is disposed at the rotation point of the swing lever.

13. A method for variation of the control times of a valve of a piston engine, in which the work range of a swing lever is varied by way of an actuator, wherein a link lever is provided between the swing lever and a camshaft, wherein the position of the link lever relative to the swing lever can be varied via the actuator, wherein the link lever rotates, relative to the swing lever, about a stationary link point, wherein said actuator carries a roll, and wherein said roll supports itself on a running surface of said link lever so that an angle between the link liver and the swing lever can be varied accordingly.

14. The method according to claim 13, wherein the stationary link point is disposed spatially between a rotation point of the swing lever and a cam track of the swing lever.

15. The method according to claim 13, wherein a rotation point of the swing lever is disposed spatially between the stationary link point and a cam track of the swing lever.

16. The method according to claim 13, wherein a cam track of the swing lever interacts with a cam stroke translator wherein the cam stroke translator is disposed between the cam track and the valve, and wherein the cam stroke translator is supported by way of two supports fixed in place on a housing, of which at least one is changed, in terms of its rigidity, during operation.

* * * * *